US006092278A

United States Patent [19]

Latkow

[11] Patent Number: 6,092,278

[45] Date of Patent: Jul. 25, 2000

[54] METHOD FOR MANUFACTURING A PENCIL-SHAPED CORE

[75] Inventor: Gary G. Latkow, Mundelein, Ill.

[73] Assignee: Tempel Steel Company, Libertyville, Ill.

[21] Appl. No.: 09/281,942

[22] Filed: Mar. 31, 1999

[51] Int. Cl.[7] ..... H01F 41/02

[52] U.S. Cl. ..... 29/609; 29/738

[58] Field of Search ..... 29/609, 738, 596

[56] References Cited

U.S. PATENT DOCUMENTS

| | | | |
|---|---|---|---|
| 4,979,285 | 12/1990 | Martin | 29/598 |
| 5,075,150 | 12/1991 | Webb et al. | 428/162 |
| 5,163,217 | 11/1992 | Sakanishi | 29/564.6 |
| 5,174,009 | 12/1992 | Martin | 29/564.6 |
| 5,349,741 | 9/1994 | Neuenschwander | 29/598 |
| 5,373,622 | 12/1994 | Neuenschwander | 29/596 |
| 5,640,752 | 6/1997 | Steiner | 29/596 |
| 5,649,349 | 7/1997 | Greenway | 29/598 |
| 5,755,023 | 5/1998 | Neuenschwander | 29/596 |
| 5,771,565 | 6/1998 | Walters | 29/596 |
| 5,791,038 | 8/1998 | Libert et al. | 29/596 |
| 5,799,387 | 9/1998 | Neuenschwander | 29/598 |
| 5,809,638 | 9/1998 | Neuenschwander | 29/609 |

FOREIGN PATENT DOCUMENTS 0 785 605 7/1997 European Pat. Off. .

*Primary Examiner*—Carl E. Hall
*Attorney, Agent, or Firm*—Hill & Simpson

[57] ABSTRACT

In a method of making a pencil core having a plurality of substantially flat laminations wherein at least one lamination at the center of the core is wider than the other laminations, a flat strip of core steel is fed into a progressive die, and a plurality of scrap region blanking stations is provided each of which blank out two spaced parallel regions from the strip, but with each of the scrap region blanking stations blanking out the regions at a different spacing. At an embossing station, at least one embossment is provided in at least each of the laminations preceding the last lamination. After all of the scrap region blanking stations, a blanking and stacking station first blanks laminations free from the strip at and corresponding to the parallel scrap regions of different spacing, and as each lamination is blanked free from the strip, that lamination is stacked onto the previously blanked laminations to form completed cores, the completed cores being held in a choking section of the blanking and stacking station. This die can also have multiple rows.

21 Claims, 5 Drawing Sheets

METHOD FOR MANUFACTURING A PENCIL-SHAPED CORE

BACKGROUND OF THE INVENTION

It is known from European Application EP 0 785 605 A1 to provide ignition voltage for a spark plug in an internal combustion engine by use of a high voltage step-up transformer mounted directly above the spark plug. The high voltage transformer utilizes a magnetic core having a pencil-shape, and thus has become commonly known as a "pencil core".

FIGS. 1A, 1B, and 1C show an illustration of such a known prior art pencil core. As generally illustrated at 10 in the cross-sectional view of FIG. 1A, a plurality of thin magnetic metal laminations 11 of varying width, but having a substantially constant thickness and a same length are stacked so that a resulting substantially circular profile shown in FIG. 1B results.

In order to maintain the stack as a unified body, it is known to provide a plurality of rectangular embossments such as 12A, 12B, and 12C in each lamination 11 so that as shown in FIG. 1A or 1B, the embossment of the upper lamination fits into the inside of the embossment of the following lamination and so on until the last lamination at the bottom of the stack such as 13, where apertures 14A, B, C are provided in lieu of the embossments so that the next to the last lamination embossments fit within the apertures 14A, B, C, in the bottom lamination so that there is no projection beyond the bottom surface of the bottom lamination.

FIG. 1C shows a plan view clearly illustrating what the prior art pencil core looks like from the top viewing down upon the top most lamination. In FIG. 1C and also FIG. 1B it can be readily seen that the central two laminations of a total of twenty laminations 11, for example, have the same width, whereas laminations above and below the two central laminations have decreasing width.

It is known that such pencil core laminations, instead of rectangular embossments, can be held together such as by welding.

SUMMARY OF THE INVENTION

It is an object of the present invention to provide a method for high volume, cost effective manufacture of a pencil core generally of the type illustrated in FIGS. 1A, 1B, and 1C.

According to the present invention, a pencil core manufacturing die according to the present invention performs the following manufacturing steps in order to cost effectively manufacture pencil cores at high volume.

First, the magnetic steel raw material in the shape of a strip known as feed stock is fed into the progressive stamping die. At a pilot hole punch station, one or more pilot holes are punched into the strip for later use in registration. Thereafter, at a first pilot registration station a pilot member is registered with the one or more pilot holes. Thereafter, in a first scrap removal station two substantially parallel scrap regions are blanked out from the feed stock strip using cam activated engagement punches. These two regions are at a given spacing from one another. Thereafter, in a second pilot registration station a pilot registration member is registered with the one or more pilot holes and thereafter a second scrap region blanking station blanks out two more spaced apart and parallel scrap regions from the strip at a different spacing than the first scrap region blanking station using cam activated engagement punch. Thereafter, the pattern repeats with pilot registration stations and scrap region blanking stations with cam activated engagement punches for as many laminations are required to reach the middle of the pencil core. For the manufacture of the two central laminations of equal width, no scrap region blanking stations are required. Moreover, for the second half of the pencil core the same pilot registration and scrap region blanking stations are employed since the pattern of changing width repeats.

Preferably the spacing of the blanked out scrap regions and the subsequent scrap region blanking stations have a constant width but increasing spacing from one another relative to a central reference line.

At some point preferably near the end of the row of scrap region blanking and pilot registration stations a piercing station is provided for piercing through holes in only the last lamination of the core.

After the last scrap region blanking station, an embossing station is provided for creating a embossment or projection which is preferably round (but could be rectangular) in each of the laminations except for the last lamination of the pencil core for interlocking the laminations. The last lamination is not embossed since that lamination has through holes from the piercing station. Therefore, the next to the last lamination projections will fit into the holes in the last lamination.

Finally, a blanking and stacking station is provided in which the laminations are cut free from the strip and pushed against one another so that the projections interlock. A choke aperture in the blanking and stacking station holds the pencil cores by the central two widest laminations. The completed stacked pencil cores then are pushed downwardly through the choking bushing until they are clear of the choking bushing and are thus delivered to an outlet of the die for completed pencil cores.

DESCRIPTION OF THE PREFERRED EMBODIMENTS

The pencil core of the prior art is modified according to the present invention for use in the manufacturing method according to the present invention. As shown in the top view in FIGS. 2A and 2B, the uppermost lamination 15 of the pencil core 16, has three circular embossments or projections 18A, 18B and 18E rather than a rectangular projection of the prior art. Such circular projections are shown interlocking with one another in FIG. 2B. The circular projections are provided in the laminations 17 except for the last lamination 19 where a corresponding hole 19A, 19B, 19C is provided. The circular projection has substantial advantages for this pencil core compared to the prior art rectangular embossments based on ease of production since the punches which make these circular projections are easier to maintain and thus simpler to design in combination with their corresponding die bushings.

Figure 1A:
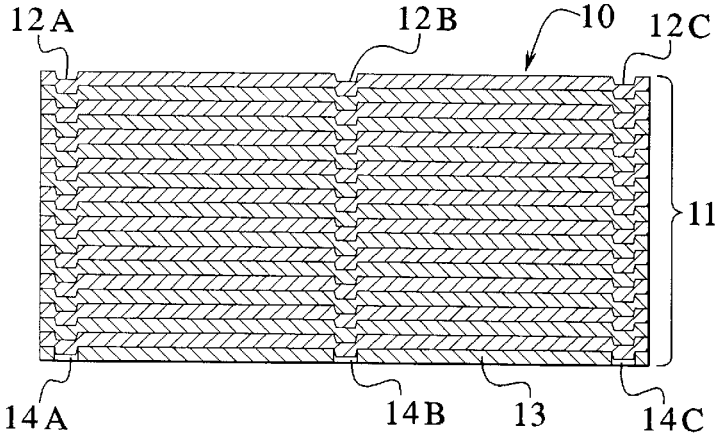
FIG.1A (PRIOR ART)
FIG. 1A is a side cross-sectional view of a prior art pencil core taken along line 1A—1A of FIG. 1C.
Figure 1B:
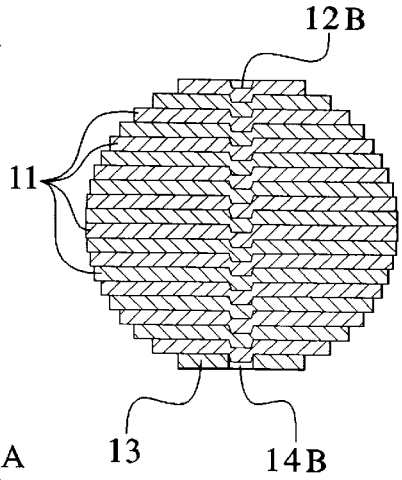
FIG.1B (PRIOR ART)
FIG. 1B is a cross-sectional view taken along the line 1B—1B of FIG. 1C of the prior art pencil core.
Figure 1C:
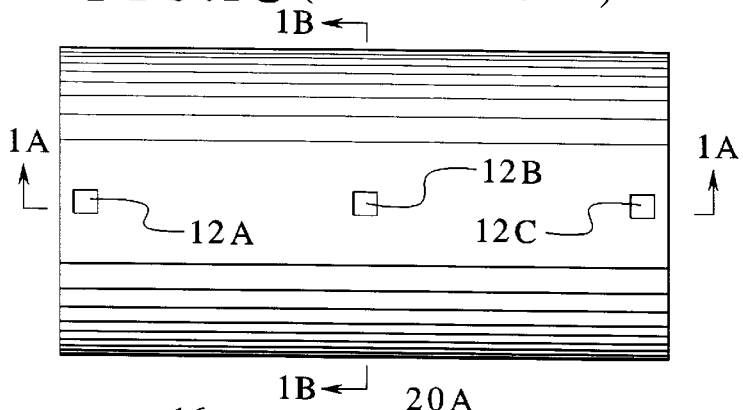
FIG.1C (PRIOR ART)
FIG. 1C is a top view of the prior art pencil core.
Figure 2A:
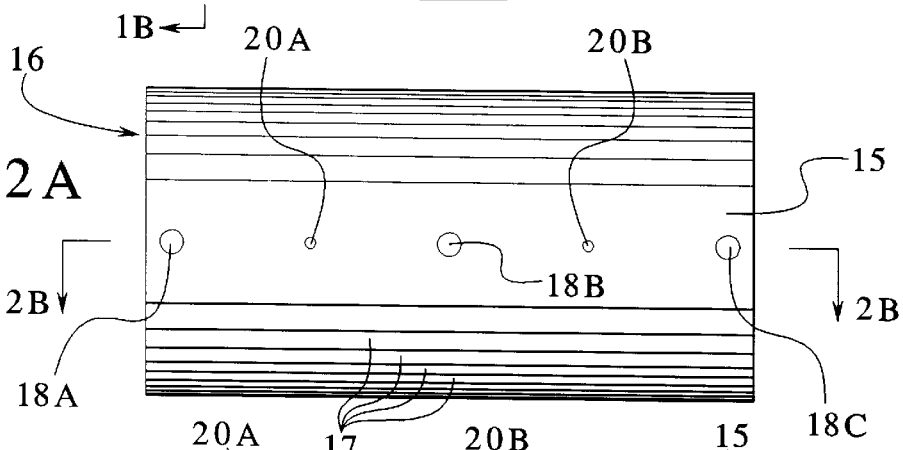
FIGS. 2A and 2B are a top view and a cross-section side view of a pencil core modified in accordance with the present invention for use in the method of the invention for manufacturing a pencil core.
Figure 2B:
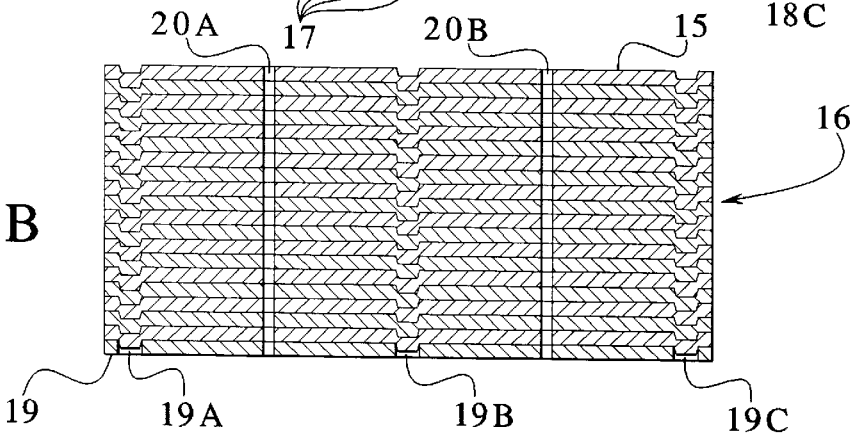

Additionally as shown in FIG. 2A and in FIG. 2B, transport holes 20A and 20B may be provided in the uppermost lamination 15 and all of the remaining laminations 17 and the bottom lamination 19 which are all in alignment with one another. Advantageously, when the pencil core exits from the die according to the present invention, the pencil cores can be grouped together by a wire passing through these transport holes from pencil core to pencil core. This simplifies transport to an annealing oven, for example.

Figure 3:
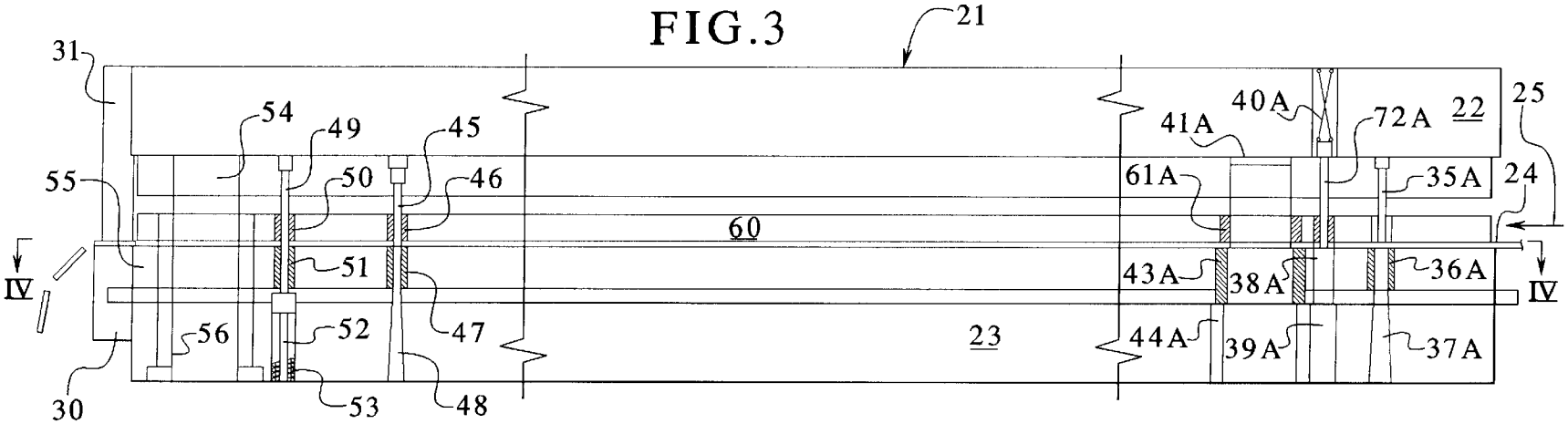
FIG. 3 is a side view taken along section line III—III of FIG. 4 showing a die used in the manufacture of pencil cores according to the present invention.

In the partial cross-sectional view of FIG. 3, the die according to the present invention utilized to manufacture the pencil cores is generally illustrated at 21. Die 21 is formed of punch holder 22 and die shoe 23. The magnetic material strip 24 shown moving from right to left by arrow 25 is positioned between the punch holder 22 and die shoe 23.

Figure 4:
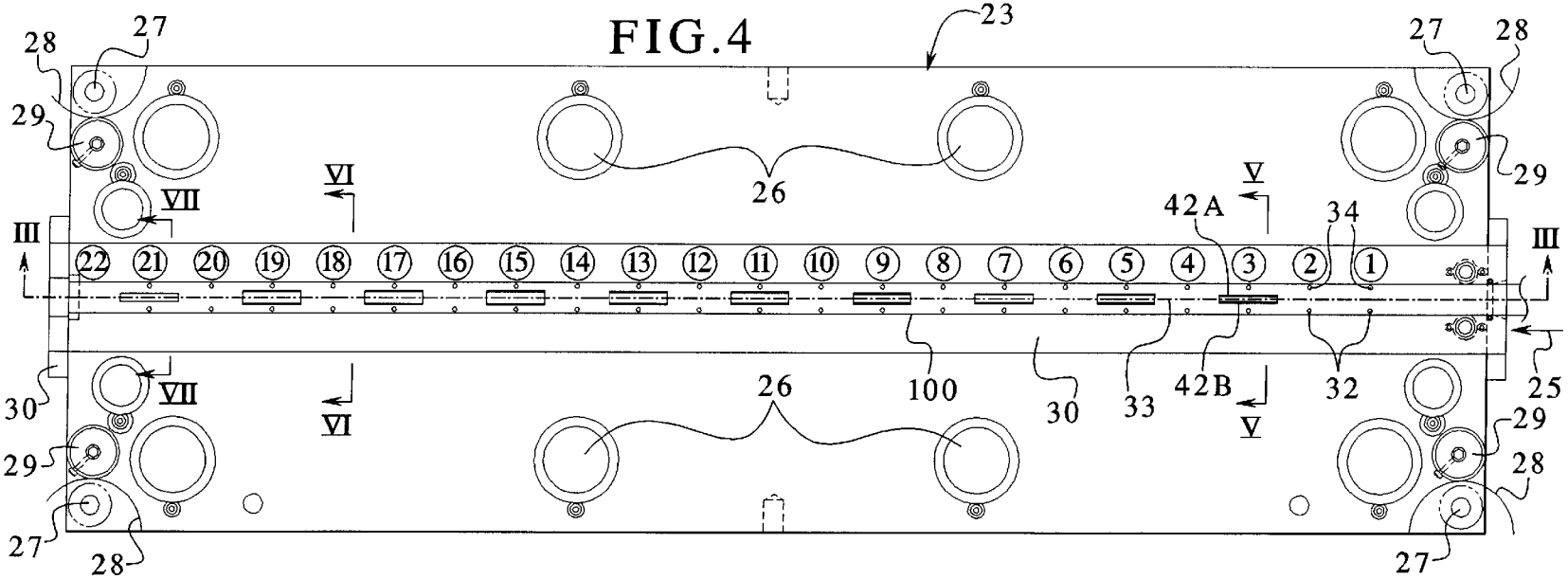
FIG. 4 is a top view taken along section line IV—IV of FIG. 3.

As shown in FIG. 4 a plurality of substantially identical die guide post bushings 26 lying at both sides of the strip 24 are provided in the die shoe 23. These die guide post bushings 26 receive corresponding mating guide pins in known prior art fashion projecting from the punch holder 22 but not otherwise shown in FIGS. 3 and 4 for clarity. Four mounting bolt holes 27 are provided at corners of the die shoe 23. Corresponding recesses 28 partially surround the mounting holes 27.

Stop blocks 29 stopping downward movement of the punch holder 22 are provided adjacent the recesses 28 at the four corners of the die shoe 23.

The strip 24 is aligned along a die block area 100.

At an end clamp 30 is provided at the outlet end of the die and a corresponding scrap cutter 31 is provided above the end clamp 30 to trim off remaining scrap portions of the strip 24 at the outlet of the die.

A plurality of stations designated 1 through 22 are illustrated in FIG. 4. The stations will be described in greater detail hereafter. To distinguish these station numbers 1 through 22 from reference numerals in the drawings, circles have been provided around the station numbers.

The construction of station 1 can be most readily seen in FIG. 3. This station 1 is a pilot perforator station which provides perforation or pilot holes 32 aligned to one side of a reference center line 33 and holes 34 lying on the opposite side of reference center line 33 (see FIG. 4). These holes are engaged by pilot members at the various pilot stations described hereafter. These pilot holes 32 and 34 are provided by corresponding punches 35A, B received in corresponding die bushings 36A, B. A slug scrap escapement 37A, B is provided beneath each of the two die bushings 36A, B.

Station 2 is exemplary of the plurality of pilot stations 2, 4, 6, 8, 10, 12, 14, 16, 18 and 20. The pilot stations each have a pair of pilot members 72A, B received in corresponding guide bushings 38A, B of the stripper. An air clearance hole 39A, B is located beneath each guide bushing 38A, B in the die block and die shoe. A pilot spring 40A, B is provided for biasing each of the pilot members 72A, B. These pilot members ensure registration of the strip as it proceeds along the die in the die block area 100.

If desired, additional pilot members 72A, B with associated pilot springs 40A, B guide bushings 38A, B, and air clearance holes 39A, B can be provided at the scrap region blanking stations as shown by the pilot holes 32 and 34 lying at both sides of the blank scrap regions at stations 3, 5, 7, 9, 11, 13, 15, 17 and 19.

The precise location of pilot stations and corresponding pilot members can be varied and the total number of such pilot stations can also be varied.

Preferably, however, a pilot station precedes each scrap region blanking station.

Figure 9:
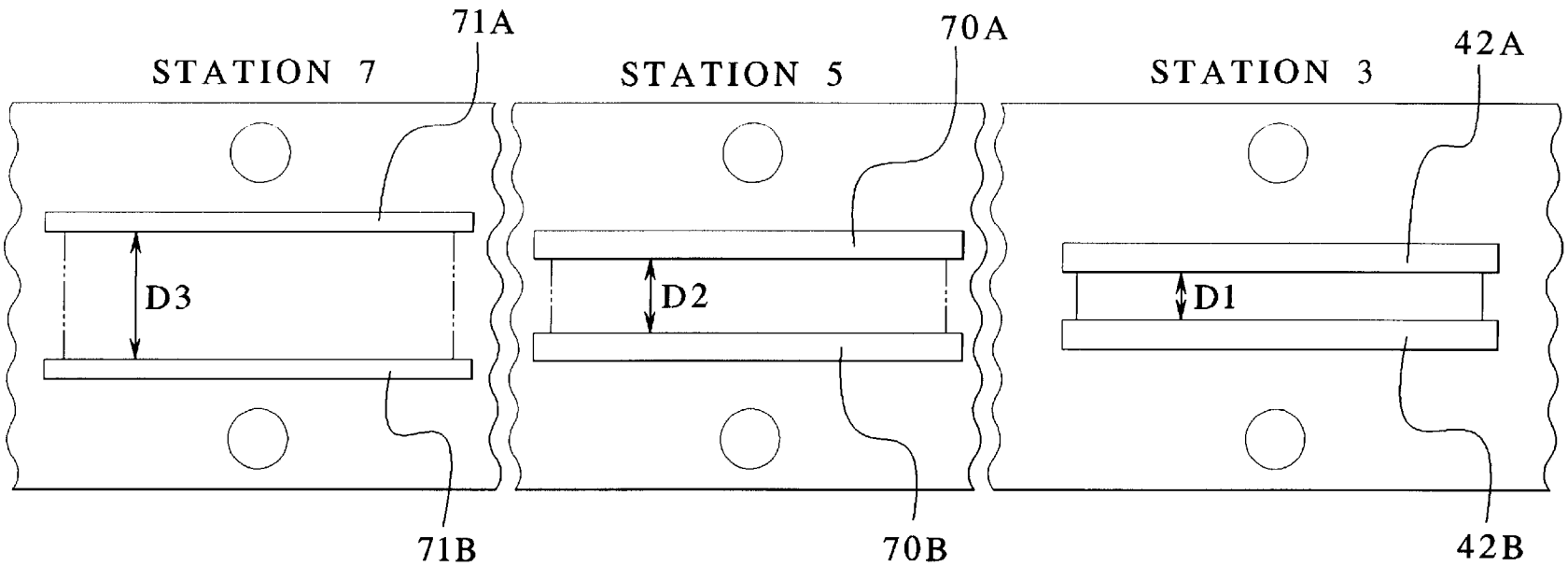
FIG. 9 is a top view of the strip as blanked at three of the scrap area blanking stations showing changing spacing of blanked scrap regions.

Station 3 is exemplary of a scrap region blanking station, and is substantially identical to additional scrap region blanking stations 5, 7, 9, 11, 13, 15, 17 and 19 except for an increasing spacing of scrap regions as shown in FIG. 9 hereafter.

In each scrap region blanking station, a pair of trim punches of rectangular configuration corresponding in shape and area to the corresponding space blanking region 42A and 42B shown in FIG. 4 but more clearly shown in FIG. 9. The trim punches 41A, B are received in respective rectangular die sections 43A, B which lie above respective scrap slug escapements 44A, B which can either be a corresponding escapement below each rectangular die section or a unified escapement for receiving scrap from both rectangular die sections.

Preferably the trim punches 41A, B in each of the scrap region blanking stations 3, 5, 7, 9, 11, 13, 15, 17 and 19 a re cam activated for selective activation in row order along the strip or in arbitrary sequences as described hereafter.

Preferably between scrap region blanking stations 17 and 19 a piercing station may be provided at the pilot member station 18 which is slide cam activated so as to provide the holes 19A, 19B, 19C only in the last lamination 19 shown in FIG. 2B. This piercing station, which provides the hole for allowing stack separation, has a punch 45 passing through a guide bushing 46 into a die bushing 47. The die bushing 47 is arranged above a s crap or slug escapement 48.

Between scrap region blanking station 19 and pilot station 20 an embossing station is provided for creating the circular embossments 18A, 18B and 18C shown in FIG. 2A. This embossing station has an embossing punch 49 received in a guide bushing 50 positioned above a die bushing 51. A shedder pin 52 biased by a spring 53 is provided. Thus, the shedder pin 52 is biased against the bottom surface of the lamination where the embossing punch 49 is creating the circular embossment 18A, 18B and 18C.

The through holes 20A and 20B shown in FIG. 2A can be added to all of the laminations at a station not shown in FIG. 3 or 4.

Figure 8:
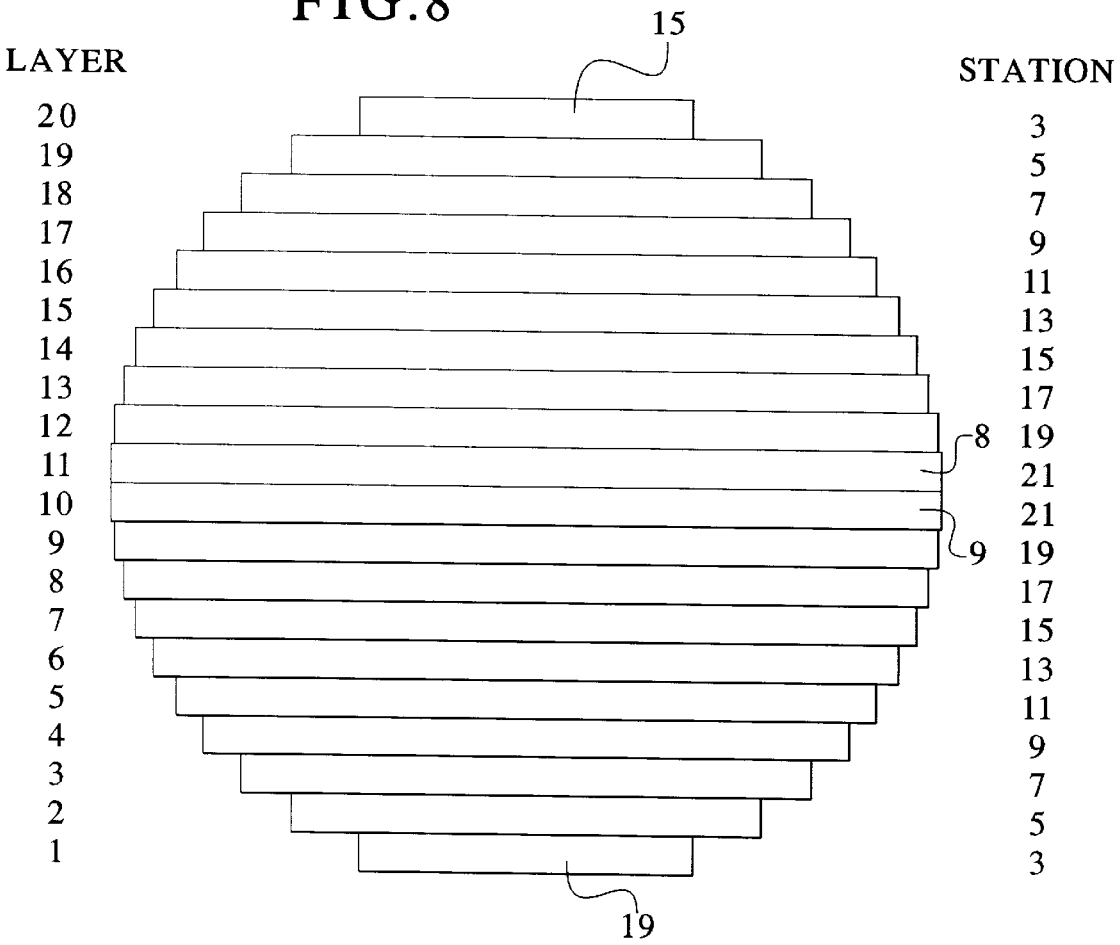
FIG. 8 is an end view of the pencil core showing correlation of layer level and the stations enumerated in FIG. 4 for each of understanding.

Finally, the station 21 is a blanking and stacking station which performs both of the blanking and stacking functions at a single station. A punch 54 is received within a die section 55 so as to blank each lamination free from the strip 24. A rectangular choking section 56 inserted into the collar section 56 having an inner dimension adapted for a tight fit with the widest two central laminations 8 and 9 as shown in FIG. 8 is provided.

Figure 5:
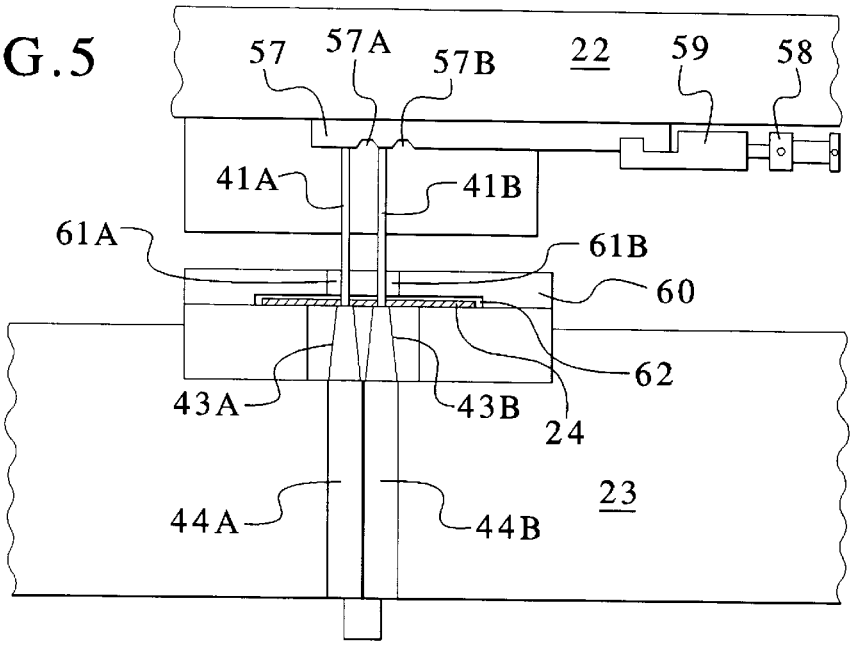
FIG. 5 is a view taken along section line V—V of FIG. 4.

FIG. 5 shows a cross-sectional end view of station 3 which is the first scrap region blanking station. Identical punches 41A, B are substantially simultaneously activated by a slide 57 having substantially identical notches 57A and 57B with cammed entry surfaces. The slide 57 is driven by an air cylinder 58 via an intermediate coupling member 59 activated via a PLC or computer. The stripper plate 60 is also shown with identical stripper guides 61 A, B. The rectangular die sections 43A, B are also shown together with corresponding scrap slug escapements 44A and 44B. The strip 24 is positioned in a strip channel 62 of the stripper plate 60.

Figure 6:
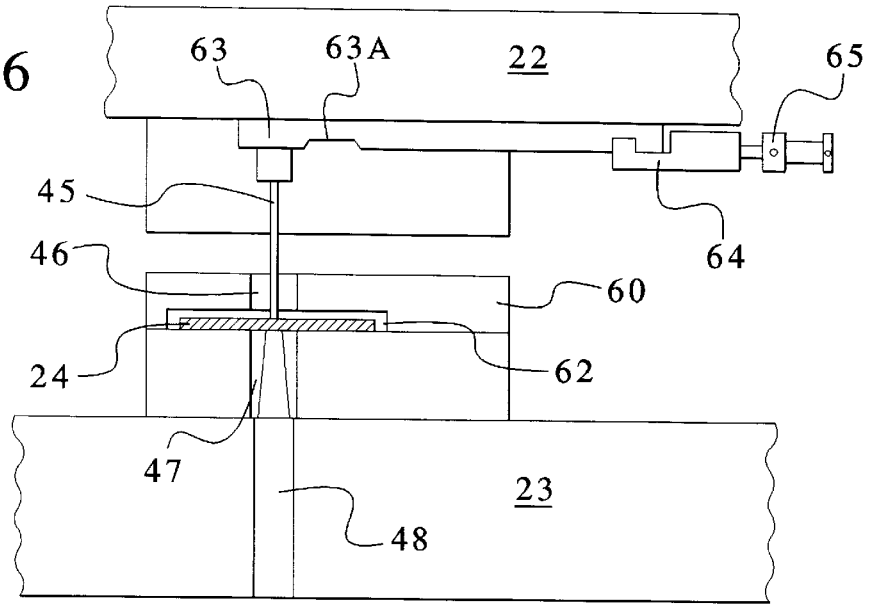
FIG. 6 is a sectional view taken along line VI—VI of FIG. 4.

FIG. 6 is a cross-sectional view taken along line VI—VI and shows the piercing station for the last lamination of each pencil core. This piercing station provides all three of t he apertures 19A, 19B shown in FIG. 2B. Thus for the last lamination, the punch 45 is actuated three times by a slide 63 and a cut out 63A. The slide is driven by a coupling member 64 driven by an air cylinder 65 activated via a PLC or computer. The punch 45 is received in the stripper guide bushing 46 and blanking occurs with the die bushing 47 position ed above the slug clearance 48.

Figure 7:
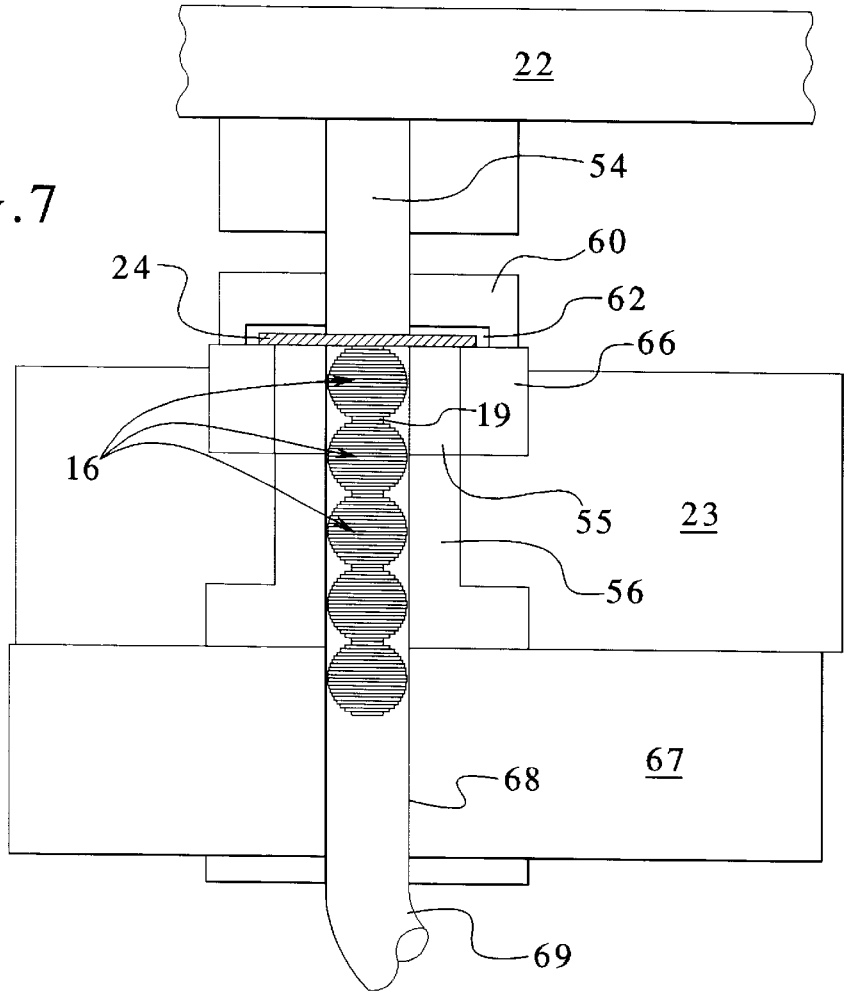
FIG. 7 is a sectional view taken along line VII—VII of FIG. 4.

FIG. 7 shows the section view along line VII—VII for the blanking and stacking station. As shown in FIG. 7, the blanking and stacking station punch 54 passes through stripper plate 60 to strike the strip 24 in the stripper channel 62. As the laminations are blanked free from the strip they are forced together such that the embossments previously described hold the individual laminations together to form unitary pencil cores 16. The last laminae 19 in each pencil core 16 does not have an embossment, but rather a hole, and therefore it is not mechanically held to the adjacent pencil core 16 lying below.

The assembled pencil cores 16 pass down through the die section 55 into the pinch or choke section 56. Finally they are released into an aperture 68 in a bolster plate 67, and they freely slide down such as to a curved chute 69 or onto a conveyor.

FIG. 8 shows correspondence in a preferred embodiment between the pencil core layer level 1 through 20 for the twenty different laminations at the left side and at the right side station numbers are provided so that it can be seen where the corresponding scrap region blanking stations 3 through 19 correspond and wherein the station 21 (which is the blanking station), which cuts free the central laminations 10 and 11. It may be appreciated that after formation of layers 1 through 10, that layers 11 through 20 which are subsequently deposited utilizing the same scrap region blanking stations. That is to say, the layers 1 through 9 requiring the different spacings for the scrap regions utilize those same scrap region blanking stations for formation of layers 12 through 20 of varying width. As previously indicated the central two laminations 10 and 11 having the same width, which is the widest width, do not require for their formation scrap region blanking since in the case of these central laminations 10 and 11 (designated with reference numerals 9 and 8), they are simply cut free from the strip at the final blanking and stacking station 21.

FIG. 9 shows more clearly the progressively wider spacing of the scrap regions for consecutive stations 3, 5 and 7, for example. It can be seen from this drawing that the width and length of the scrap regions 42A; 42B; 70A; 70B; and 71A, 71B are constant, but that the spacing D1 is smaller than spacing D2, which in turn is smaller than spacing D3. Thus when the respective laminae represented by these scrap regions are blanked out at the blanking and stacking station 21, the different widths for respective laminaes 1, 2 and 3 shown in FIG. 8 result. Of course, alternatively the station 3, 5 and 7 are utilized in the formation of the laminations 20, 19, and 18 in the second half of the pencil core, as shown in FIG. 8.

It should be understood that although twenty layer levels were shown for the pencil core in FIG. 8, that differing numbers of layer levels may be employed. It should also be understood that the slide cam actuating of the various scrap region blanking stations can be sequenced in varying ways.

Also, it should be understood that this die can have multiple rows.

Although various minor modifications might be suggested by those skilled in the art, it should be understood that I wish to embody within the scope of the patent warranted hereon all such modifications as reasonably and properly come with the scope of my contribution to the art.

I claim as my invention:

1. A method of making a pencil core for use with a coil for igniting spark plugs, said core having a plurality of substantially flat rectangular laminations where a width of at least one lamination at a center of the core is wider than the other laminations so that laminations above and below the at least one central lamination have decreasing widths, and wherein the laminations have a substantially same thickness and a substantially same length, comprising the steps of:

feeding a flat strip of core steel into a die having a plurality of stations;

punching pilot holes in the strip;

registering the pilot holes with pilot registration members;

providing a plurality of scrap region blanking stations each of which blank out two spaced parallel regions of a same unchanging area from the strip but with each of the scrap region blanking stations blanking out the regions at a different spacing thereby creating a series of said laminations, to be used, above and below the at least one central lamination and having decreasing widths;

at a lowermost lamination of the core to be formed providing at least one pierced hole with a piercing station and at an embossing station providing at least one embossment in each of the laminations preceding the last lamination for each core to provide an embossment for interlocking the laminations together with one embossment being received within a succeeding inside surface of the embossment in the following lamination and wherein the last embossment is received in the pierced hole of the last lamination; and after all of the scrap region blanking stations, the piercing station, and the embossing station, arranging a blanking and stacking station which first blanks laminations free from the strip at and corresponding to the parallel scrap regions of differing spacing, and for said at least one central lamination of the core blanking the strip without any associated parallel scrap regions, and as each lamination is blanked free from the strip, stacking that lamination onto previously blanked laminations so as to interlock the laminations with the embossments in unified completed cores of a substantially circular file which are held in a choking section of the blanking and stocking station which holds the cores by the widest at least one central lamination, the cores then being pushed down through the choking section and thereafter output from the die.

2. The method according to claim 1, wherein two central laminations have a same width which is the greatest width of all laminations in each core and wherein separate scrap region blanking stations are provided for each of the laminations lying below the two central widest laminations for creation of those lamination widths, and the same scrap region blanking stations being used for creation of all of the narrower laminations above the two central widest laminations.

3. The met hod according to claim 1 including the step of providing the embossment as circular.

4. The method according to claim 1 including the step of providing the first station as the pilot hole punching station, the next station as a pilot registration station, the next station as a first of said scrap region blanking stations followed by a plurality of additional scrap region blanking stations, thereafter arranging the piercing station for the hole in the last lamination of each core between the last two scrap region blanking stations, and arranging the embossing station between the last scrap region blanking station and the blanking and stacking station.

5. The method according to claim 1 wherein for each core each of the scrap region blanking stations is activated twice, the piercing station for the at least one hole for the last lamination is activated once, and the embossing station is activated for said at least one embossment a number of times equal to the total number of laminations in the core minus one.

6. The method according to claim 1 wherein for a total of n laminations in each core, providing (n−2)/2 scrap region blanking stations where n=a total number of laminations in each core.

7. The method according to claim 1 wherein each of the scrap region blanking stations is cam activated.

8. The method according to claim 1 wherein the piercing station for the hole and the last lamination is cam activated.

9. The method according to claim 1 including the step of providing three circular embossments in each of the laminations except the last lamination for each core, and providing three corresponding holes in the last lamination of each core.

10. The method according to claim 1 including the step of providing at least one transport hole in each lamination such that for each core with all laminations interlocked to each other the transport holes line up to permit a wire to be passed through the hole for carrying a plurality of finished cores together on a single wire.

11. The method according to claim 1 including the step of providing a stripper plate between the strip and a punch holder and wherein the stripper plate has a stripper channel for passing the strip therethrough.

12. The method according to claim 1 including the step of preceding each scrap region blanking station by a pilot registration station which inserts a pilot member into pilot holes.

13. The method according to claim 1 including the step of providing a total of twenty laminations in each core with two central laminations at the center of each core being of a same width with all further laminations above and below the two central laminations having a decreasing width so that a cross-sectional profile of each completed core is approximately round.

14. A method of making a core having a plurality of substantially flat laminations where a width of at least one lamination at a center of the core is wider than the other laminations so that laminations above and below the at least one central lamination have decreasing widths, comprising the steps of:

feeding a flat strip of core steel into a die having a plurality of stations;

providing a plurality of scrap region blanking stations each of which blank out two spaced parallel regions of a same unchanging area from the strip but with at least some of the scrap region blanking stations blanking out the regions at a different spacing thereby creating a series of said laminations, to be used, above and below the at least one central lamination and having decreasing widths;

at an embossing station providing at least one embossment in at least each of the laminations preceding the last lamination for each core to provide an embossment for interlocking the laminations together with one embossment being received within a succeeding inside surface of the embossment in the following lamination; and after all of the scrap region blanking stations and the embossing station, arranging a blanking and stacking station which first blanks laminations free from the strip at and corresponding to the parallel scrap regions of differing spacing, and as each lamination is blanked free from the strip, stacking that lamination onto previously blanked laminations so as to interlock the laminations with the embossments in unified completed cores of a substantially circular profile which are held in a choking section of the blanking and stacking station which holds the cores by the widest at least one central lamination, the cores then being pushed down through the choking section and output from the die.

15. A method of making a core having a plurality of substantially flat laminations where a width of at least one lamination at a center of the core is wider than the other laminations so that laminations above and below the at least one central lamination have decreasing widths, comprising the steps of:

feeding a flat strip of core steel into a die having a plurality of stations;

providing a plurality of scrap region blanking stations each of which blank out two spaced regions of a same unchanging area from the strip but with at least some of the scrap region blanking stations blanking out the regions at a different spacing thereby creating a series of said laminations, to be used, above and below the at least one central lamination and having widths; and after all of the scrap region blanking stations and the embossing station, arranging a blanking and stacking station which first blanks laminations free from the strip at and corresponding to the scrap regions of differing spacing, and as each lamination is blanked free from the strip, stacking that lamination onto previously blanked laminations to form completed cores of a substantially circular profile which are held in a choking section of the blanking and stocking station which holds the cores by the widest at least one central lamination, the cores then being pushed down through the choking section and output from the die.

16. The method according to claim 1 including the step of:

aligning the scrap region blanking stations so that the two spaced parallel regions lie symmetrically to each side of a center line of the flat strip.

17. The method according to claim 14 including the step of:

aligning the scrap region blanking stations so that the two spaced parallel regions lie symmetrically to each side of a center line of the flat strip.

18. The method according to claim 15 including the step of:

aligning the scrap region blanking stations so that the two spaced parallel regions lie symmetrically to each side of a center line of the flat strip.

19. The method according to claim 1 wherein pilot holes are provided lying outwardly of each scrap region and also the pilot holes are provided outwardly of a non-blanked region lying between scrap region pairs in a longitudinal direction of said flat strip.

20. The method according to claim 14 wherein pilot holes are provided lying outwardly of each scrap region and also the pilot holes are provided outwardly of a non-blanked region lying between scrap region pairs in a longitudinal direction of said flat strip.

21. The method according to claim 15 wherein pilot holes are provided lying outwardly of each scrap region and also the pilot holes are provided outwardly of a non-blanked region lying between scrap region pairs in a longitudinal direction of said flat strip.

* * * * *